US006553796B2

(12) United States Patent
Finch

(10) Patent No.: US 6,553,796 B2
(45) Date of Patent: Apr. 29, 2003

(54) ELECTRICAL PANEL LOCK WITH LOCKING PLUG HEAD

(75) Inventor: Glyn A. Finch, Simpsonville, SC (US)

(73) Assignee: CompX International Inc., Mauldin, SC (US)

( * ) Notice: Subject to any disclaimer, the term of this patent is extended or adjusted under 35 U.S.C. 154(b) by 0 days.

(21) Appl. No.: 09/859,922

(22) Filed: May 17, 2001

(65) Prior Publication Data

US 2001/0049950 A1 Dec. 13, 2001

Related U.S. Application Data

(60) Provisional application No. 60/205,398, filed on May 19, 2000.

(51) Int. Cl.[7] ..... E05B 13/10; E05B 55/04
(52) U.S. Cl. ..... 70/208; 70/224; 70/478
(58) Field of Search ..... 70/208, 210, 215, 70/224, 221, 478

(56) References Cited

U.S. PATENT DOCUMENTS

| | | | | |
|---|---|---|---|---|
| 4,578,963 A | | 4/1986 | Messier, Jr. | |
| 4,882,919 A | | 11/1989 | Craig | |
| 5,263,346 A | * | 11/1993 | Sato et al. | 292/DIG. 38 |
| 6,023,953 A | | 2/2000 | Vickers et al. | |
| 6,041,627 A | * | 3/2000 | Buckland | 292/DIG. 60 |
| 6,145,352 A | * | 11/2000 | Vickers et al. | 292/DIG. 31 |
| 6,174,007 B1 | * | 1/2001 | Schlack et al. | 292/336.3 |

* cited by examiner

*Primary Examiner*—Anthony Knight
*Assistant Examiner*—Michael J. Kyle
(74) *Attorney, Agent, or Firm*—Banner & Witcoff, Ltd.

(57) ABSTRACT

A panel lock includes a housing with a pivotal face plate arranged to engage a bolt upon pivotal movement of the face plate. A rotatable plug assembly may be rotated between a locking and unlocking position to restrain or release the push plate.

6 Claims, 5 Drawing Sheets

ELECTRICAL PANEL LOCK WITH LOCKING PLUG HEAD

CROSS REFERENCE TO RELATED APPLICATION

This is a utility application based upon provisional application Ser. No. 60/205,398 filed May 19, 2000 which is incorporated herewith by reference for which priority is claimed.

BACKGROUND OF THE INVENTION

In a principal aspect the present invention relates to a plug lock and more particularly, a flush mounted plug lock or panel lock which may be snapped into a recess of a panel door and which includes a projecting bolt cooperative with a strike to retain the door in a closed and locked position.

Various prior art patents disclose panel locks which are used to close and lock panels such as cabinet panels, locker door panels and the like. For example, U.S. Pat. No. 4,882,919 for a Flush Mounted Panel Lock Construction discloses such a mechanism. Other patents disclosing such mechanisms include U.S. Pat. No. 6,023,953 for a Slam Latch With Opposing Slides and U.S. Pat. No. 4,578,968 for a Flush Mount Lock Assembly. Typically, such locks include a pivotal push plate which is mounted for rotation about a pin or axis in the lock housing. A rotatable key actuated plug assembly actuates a lock plate provided for engagement with the push plate to lock or release the push plate. When the push plate is released pivoting action of the push plate effects release of a bolt. When the plug assembly is in the locked position, the push plate may not be pivoted and, thus, the bolt may not be disengaged from a strike.

SUMMARY OF THE INVENTION

Briefly, the present invention comprises a panel lock which includes a housing with a cavity having a push plate pivotally mounted therein for engagement with a slidable bolt upon pivotal movement of the push plate. A rotatable plug assembly in the housing includes a plug head with a partially circumferential flange that may be aligned over ribs in the push plate to thereby engage and hold the push plate in the housing and preclude pivotal movement of the push plate. The plug head may be rotated to a position where the flange is removed from engaging the push plate ribs so that the push plate may be pivoted about its mounting axis to release the bolt from a strike.

Thus, it is an object of the invention to provide an improved panel lock construction.

It is a further object of the invention to provide a panel lock construction having a minimum number of parts wherein a pivotal push plate may be engaged and locked by a rotatable key actuated plug lock assembly mounted in the housing for the lock.

Yet another object of the invention is to provide an inexpensive, yet rugged and durable, panel lock. These and other objects, advantages and features of the invention will be set forth in the detailed description which follows.

BRIEF DESCRIPTION OF THE DRAWINGS

In the detailed description which follows, reference will be made with the drawing, comprised of the following figures.

DESCRIPTION OF THE PREFERRED EMBODIMENT

Figure 1:
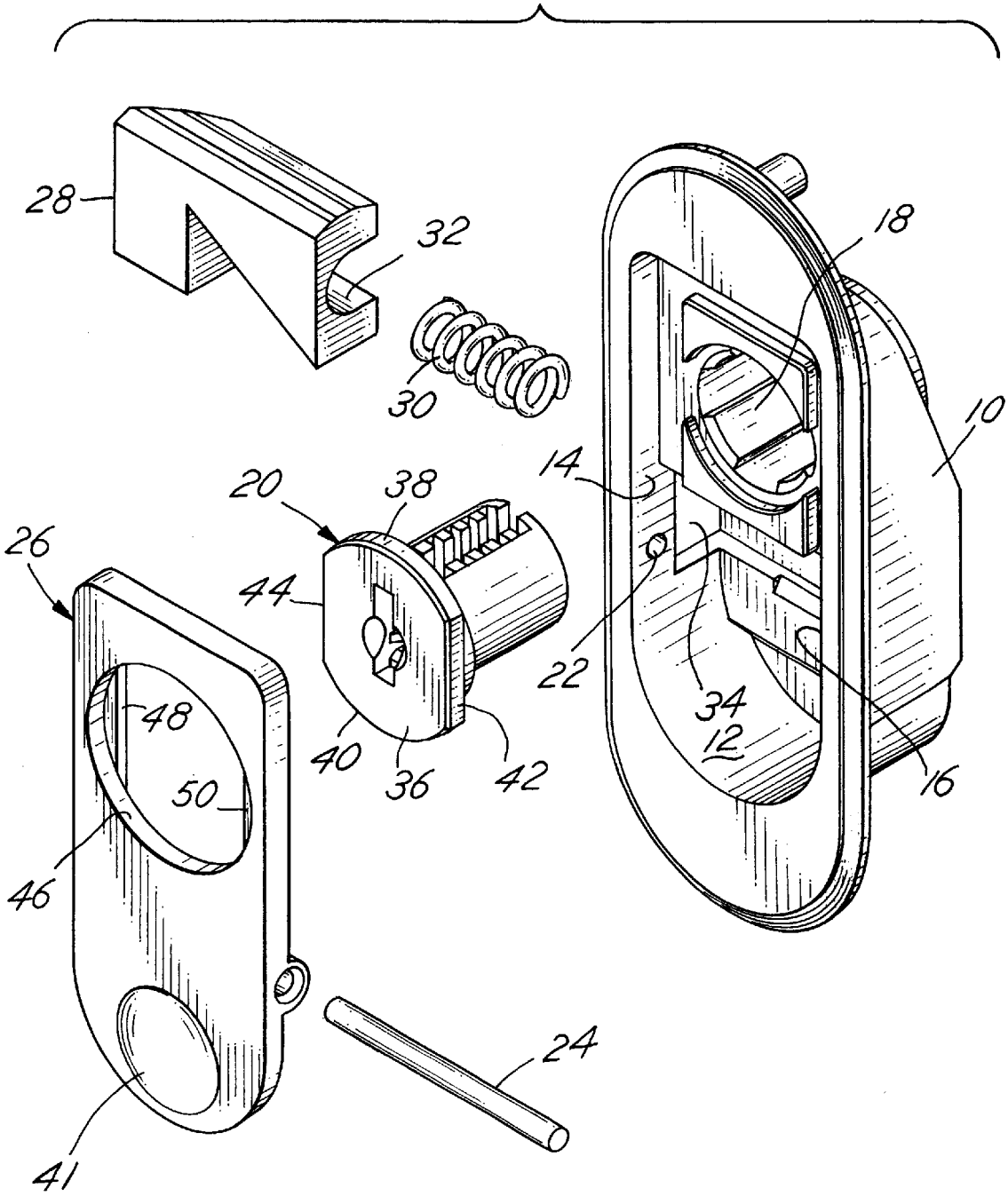
FIG. 1 is an exploded isometric view of the panel lock.
Figure 2:
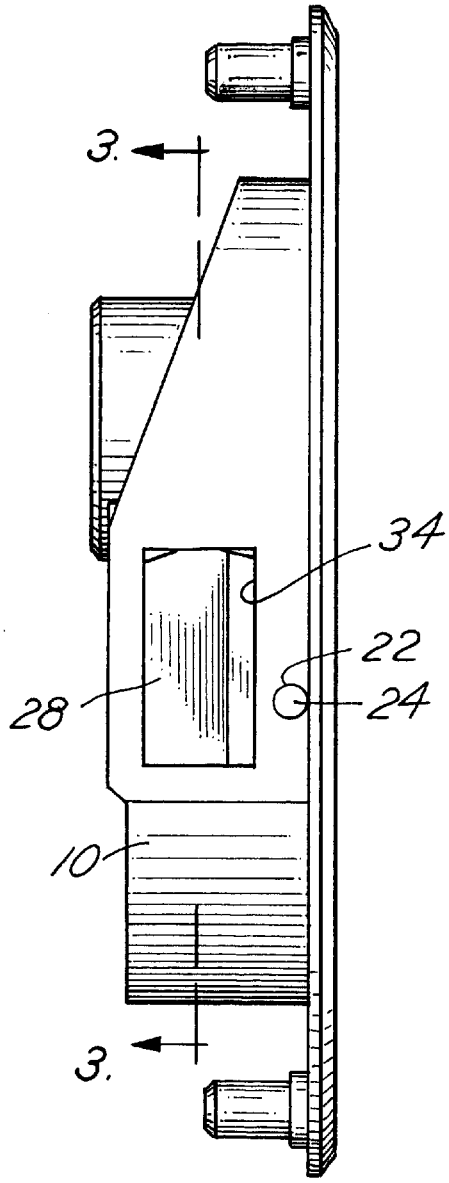
FIG. 2 is a side elevation of the assembled panel lock depicted in FIG. 1.

Referring to the Figures, the panel lock includes a housing 10 with a recess or cavity 12. The chamber or cavity 12 includes spaced, opposed, generally parallel sides or sidewalls 14 and 16. Each of the sides 14 and 16 include pivot pin openings such as pin opening 22 for receipt of a mounting pin 24 which is provided to pivotally mount a push plate 26 having a configuration generally congruent with the opening of cavity 12. A slidable bolt 28 is mounted in the cavity 12 and is biased by a spring 30 which fits into a bore 32 in bolt 28 to bias the bolt 28 outwardly from cavity 12 through a lateral or side opening 34 in the wall 14 of housing 10.

The housing 10 further includes a generally cylindrical bore or counterbore cavity 18 for receipt of a rotatable plug assembly or lock plug 20. The plug 20 is rotatably mounted in the counterbore cavity 18 and includes a plug head 36 which has opposite, outwardly extending arcuate sides 38 and 40 comprising a flange. The plug head 36 further includes opposite flat sides 42 and 44 connecting the arcuate sides 38, 40. In other words, the plug head 36, which ordinarily may be circular in shape, has sectors removed from the circular plug head 36 resulting in flat sides 42 and 44 that connect the partial peripheral, flange sides or sections 38 and 40.

Figure 3:
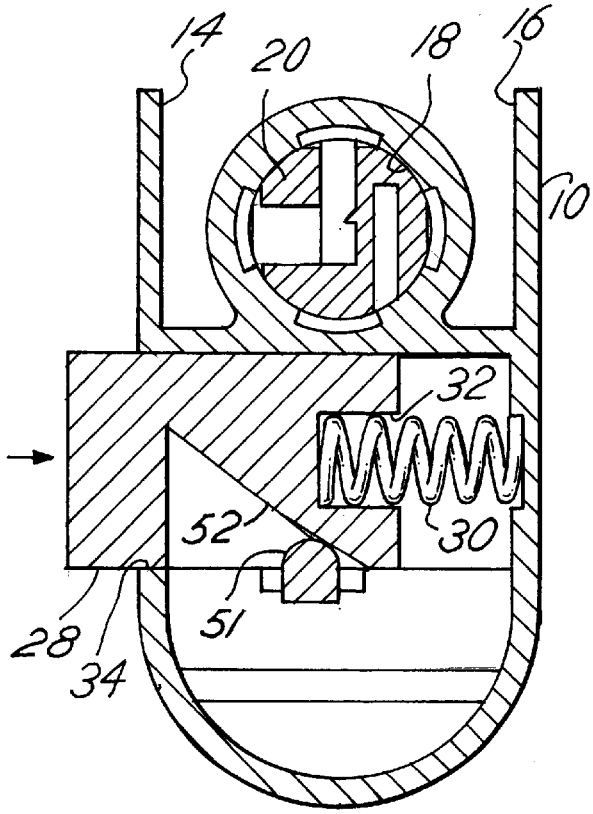
FIG. 3 is a cross sectional view of the panel lock of FIG. 2 taken along the line 3—3 in FIG. 2.

The push plate 26 includes a generally circular counterbore 46 with first and second underlying spaced, opposite side ribs or flanges 48 and 50 provided on the bottom side of the push plate 26 in the counter bore 46. Push plate 26 further includes a cam 51 on its underside which may be engaged with an inclined follower surface 52 of the bolt 28 so that when the push plate 26 is pivoted by pushing on a push surface 41 about the pin 24, the cam 51 will engage the follower surface 52 and translate the bolt 28 inwardly into housing 10 in the direction of the arrow in FIG. 3 against the biasing force of the biasing member or spring 30.

Figure 4:
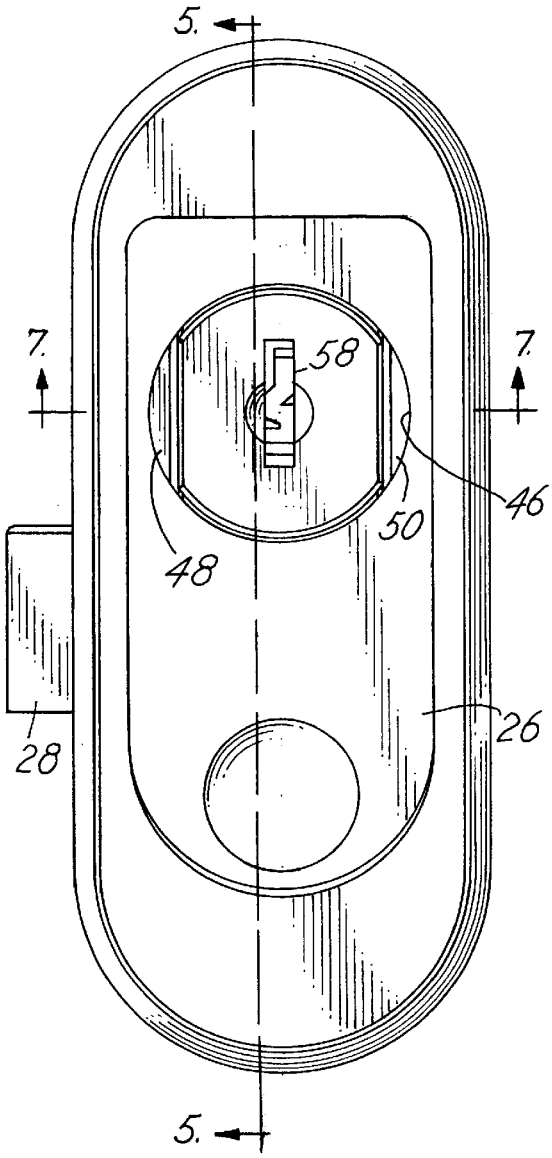
FIG. 4 is a top or front plan view of the panel lock.
Figure 9:
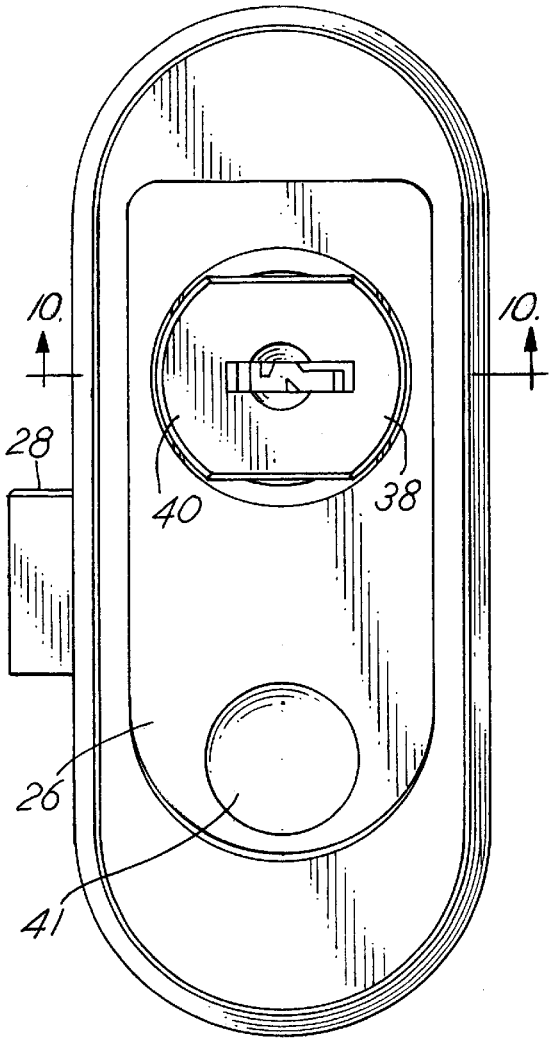
FIG. 9 is a plan view of the panel lock with the plug in the locked position.
Figure 7:
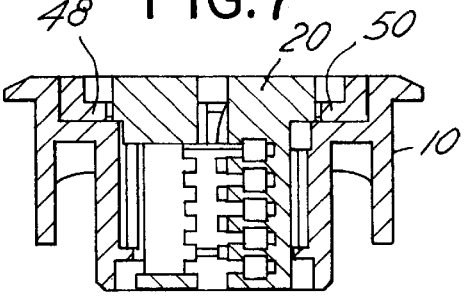
FIG. 7 is an isometric view of the plug for the panel lock.
Figure 10:
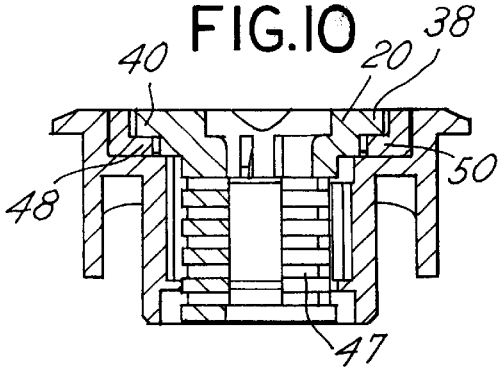
FIG. 10 is a cross-sectional view of the panel lock of FIG. 9 taken along the line 10—10.
Figure 5:
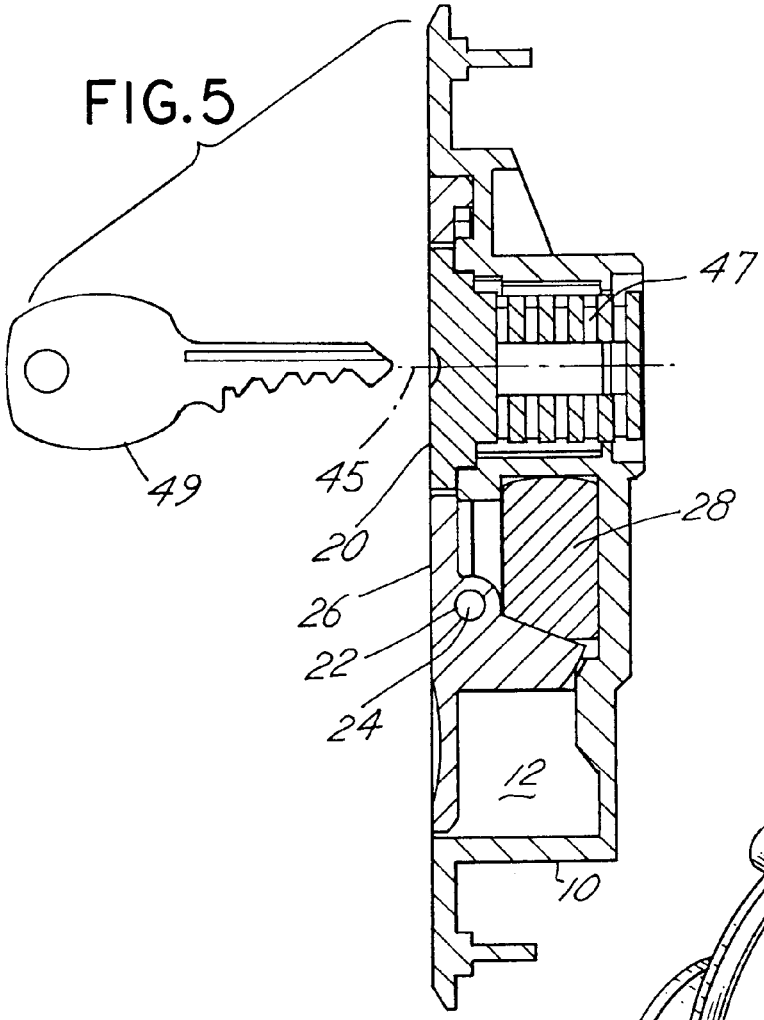
FIG. 5 is a cross-sectional view of the panel lock of FIG. 4 taken along the line 5—5.
Figure 8:
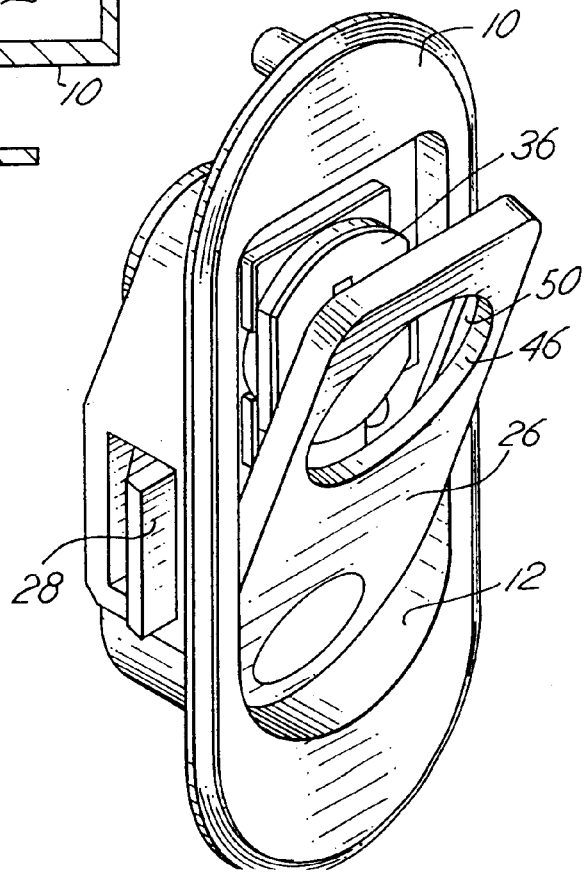
FIG. 8 is an isometric view of the panel lock with the push plate moved to the bolt unlocking position.
Figure 6:
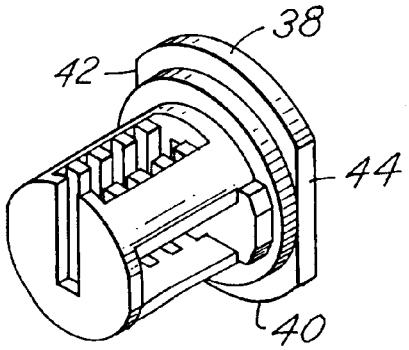
FIG. 6 is a sectional view of the panel lock of FIG. 4 taken along the line 6—6.
Figure 11:
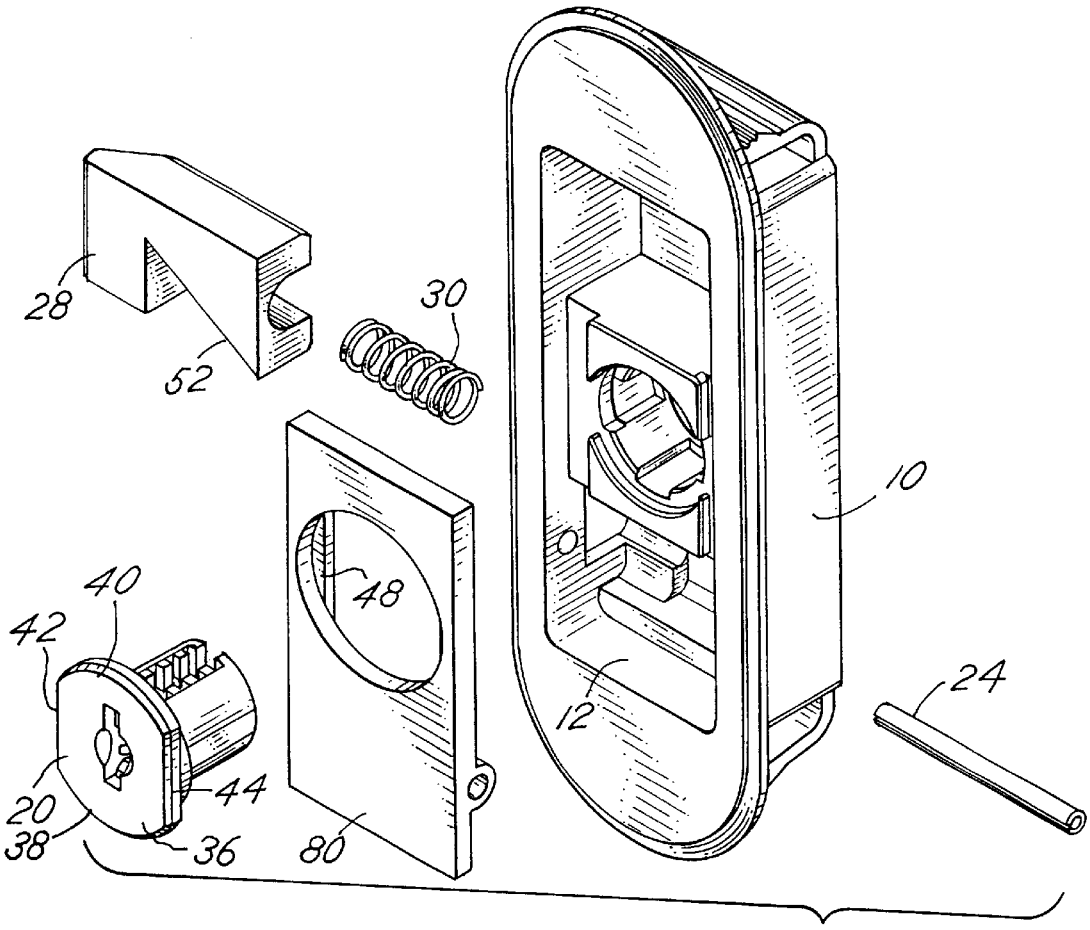
FIG. 11 is an exploded isometric view of an alternate construction.

An important feature of the invention relates to the construction of the plug head 36 and the opening 46 through the face plate 26. Thus, the ribs 48 and 50 of the push plate 26 underlie the arcuate flanges 38 and 40 of the plug head 36 of the plug 20 whenever the plug 20 has been rotated about a plug axis 45 to a locked position such as indicated in FIG. 5. Referring to FIG. 9 and FIG. 10, the ribs 48 and 50 underlie the flanges or flange sections 38 and 40 of plug head 36 when the rotatable plug assembly or lock plug 20 is rotated to the locked position and the push plate 26 is in the locked position with respect to the bolt 28. In order to release the push plate 26 and permit rotation thereof about the pin 24, a key 49 is inserted through a keyhole slot 58 to align tumblers 47 of the plug 20 permitting rotation of the rotatable plug assembly. The plug 20 is thus released from locking engagement with the bore 18 and then may be rotated to the position depicted in FIG. 4. When in this position as also depicted in FIG. 11, the ribs 48 and 50 no longer engage with the flanges 38 and 40. The push plate 26 may then be pushed or pivoted as depicted in FIG. 8 to drive the bolt 28 to the open position.

Figure 12:
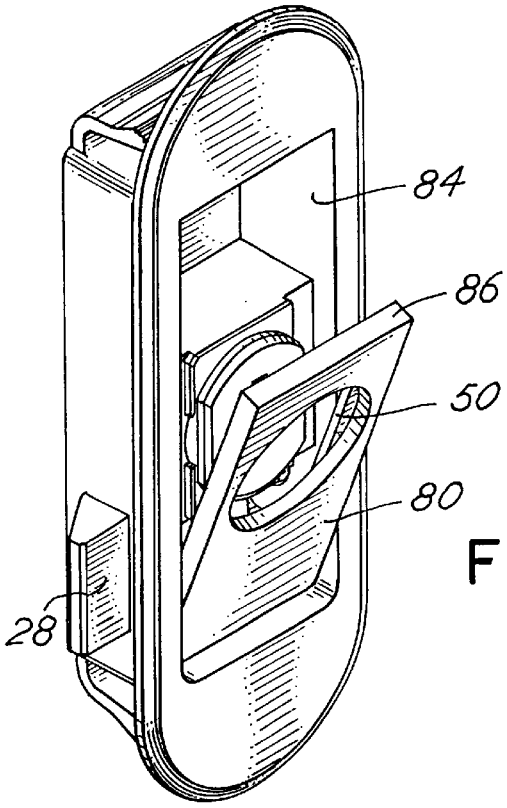
FIG. 12 is an isometric view of the construction of FIG. 11 assembled.

FIGS. 11 and 12 depict an alternative embodiment wherein a faceplate 80 may be pulled to release a bolt. Like components of the embodiments have like numbers. The embodiment of FIGS. 11–12 differs from that of FIGS. 1–10 inasmuch as plate 80 is shortened so that it may be pulled rather than pushed to pivot and thereby move the bolt 28. Thus a finger cavity 84 is provided in the housing 10 so that an operator may engage an edge 86 of pivotal, shortened plate or pull 80.

It is possible to alter the construction of the cooperating flanges associated with the plug head 36 and the opening 46 of the face plate 26 to accomplish the described result. Various other modifications may be made to the panel lock without departing from the spirit and scope of the invention. The invention is therefore to be limited only by the following claims and equivalents thereof.

What is claimed is:

1. A panel lock comprising, in combination:

a housing including a cavity, said housing having opposite sides and a front face opening for accessing the cavity;

a plate, said plate positioned in the front face opening and including opposite sides pivotally attached to the opposite sides respectively of the housing cavity for pivotal movement about an axis extending between the opposite sides between a locking position and an unlocking position;

a bolt slidably mounted within the housing cavity and projecting through a passage in one of said sides of the cavity to engage a strike, said bolt slidable into the housing in response to pivoting of the plate about the axis to the unlocking position; and a rotatable plug assembly mounted in the housing, said rotatable plug assembly including a plug head with a partially circumferential flange and a key slot for receipt of a key to actuate the rotatable plug assembly;

said plate having an opening for receiving the plug head, said opening including at least one underlying flange which underlies the plug head flange when the rotatable plug assembly and plate are both in their locking position.

2. The panel lock of claim 1 including a biasing member in the cavity for biasing the bolt to the locking position.

3. The panel lock of claim 1 further including a cam actuator on the plate and a follower on the bolt, said cam actuator engaging the follower to translate the bolt to the unlocking position by pivotal movement of the plate.

4. A panel lock comprising, in combination:

a housing with a cavity, said cavity including a front opening with opposite sides;

a key actuated plug assembly rotatably mounted in the housing, said key actuated plug assembly including a plug head having a partially circumferential peripheral flange;

a bolt slidably mounted in the cavity and extendable through one of said sides of the housing to engage a strike;

a biasing member in the cavity for engaging the bolt and biasing the bolt outwardly from the housing to engage a strike; and a plate pivotably mounted in the front opening of the cavity, said plate including a passage therethrough for the plug head, said passage including a radially inwardly extending flange which underlies the plug head flange when the plug head is positioned in the plate passage and the plug head is in the locking position.

5. The panel lock of claim 1 or claim 4 wherein the plate is a push plate which covers the cavity in the locking position.

6. The panel lock of claim 1 or claim 4 wherein the plate is a pull plate which covers a portion of the cavity in the locking position.

* * * * *